US006669466B2

(12) United States Patent
Dijkstra

(10) Patent No.: US 6,669,466 B2
(45) Date of Patent: Dec. 30, 2003

(54) UTILITY LIGHTER

(75) Inventor: Treed Dijkstra, Leideror (NL)

(73) Assignee: Zippo Manufacturing Company, Bradford, PA (US)

( * ) Notice: Subject to any disclaimer, the term of this patent is extended or adjusted under 35 U.S.C. 154(b) by 0 days.

(21) Appl. No.: 10/206,379

(22) Filed: Jul. 26, 2002

(65) Prior Publication Data

US 2003/0022122 A1 Jan. 30, 2003

Related U.S. Application Data

(60) Provisional application No. 60/308,348, filed on Jul. 27, 2001.

(51) Int. Cl.[7] ..... F23D 11/36

(52) U.S. Cl. ..... 431/153; 431/255

(58) Field of Search ..... 431/153, 255, 431/344, 256; 126/407–409, 413, 414

(56) References Cited

U.S. PATENT DOCUMENTS

| | | | | |
|---|---|---|---|---|
| 4,259,059 | A | | 3/1981 | Roosa et al. |
| 4,315,731 | A | | 2/1982 | Moore |
| 4,389,187 | A | | 6/1983 | Sims |
| RE31,316 | E | | 7/1983 | Moore |
| 4,419,069 | A | | 12/1983 | Piffath |
| 4,424,018 | A | | 1/1984 | Lowther, Sr. |
| 4,462,791 | A | | 7/1984 | Hayden |
| 4,649,260 | A | | 3/1987 | Melis et al. |
| D293,603 | S | | 1/1988 | Matsumaru |
| 4,720,259 | A | | 1/1988 | Day |
| D295,598 | S | | 5/1988 | Takase |
| D298,272 | S | | 10/1988 | Nitta |
| 4,891,005 | A | | 1/1990 | Carter |
| 4,919,111 | A | | 4/1990 | Ohsawa |
| D314,118 | S | | 1/1991 | Lloveras Capilla |
| 5,076,783 | A | | 12/1991 | Fremund |
| D327,813 | S | | 7/1992 | Shike et al. |
| 5,135,388 | A | | 8/1992 | Pettit |
| 5,154,601 | A | | 10/1992 | Lloveras Capilla |
| 5,222,889 | A | | 6/1993 | Hsu |
| D345,489 | S | | 3/1994 | Moh |
| 5,322,433 | A | | 6/1994 | Shike et al. |
| 5,327,879 | A | | 7/1994 | Ferraro |
| D353,971 | S | | 1/1995 | Inoue |
| D354,196 | S | | 1/1995 | Inoue |
| D360,107 | S | | 7/1995 | Segawa |
| D360,557 | S | | 7/1995 | Ono et al. |
| 5,460,521 | A | * | 10/1995 | Tsai ..... 431/153 |
| D364,778 | S | | 12/1995 | Choi |
| D365,726 | S | | 1/1996 | Hsu |
| 5,490,496 | A | | 2/1996 | Lin |
| 5,496,169 | A | * | 3/1996 | Chen ..... 431/255 |
| D377,736 | S | | 2/1997 | Iwagaki et al. |
| 5,616,022 | A | | 4/1997 | Moran, IV |
| D379,415 | S | | 5/1997 | Mindle |
| D380,936 | S | | 7/1997 | Hsu |

(List continued on next page.)

*Primary Examiner*—James C. Yeung
(74) *Attorney, Agent, or Firm*—Hodgson Russ LLP

(57) ABSTRACT

The present invention is directed to a utility lighter having a housing, a nozzle, a lighter fluid reservoir, a conduit, an igniter assembly, a valve actuator, and a locking device. The housing has a top side, a bottom side, sides, a distal end, and a proximal end. The nozzle extends away from the distal end and has a nozzle tip. The lighter fluid reservoir is in the distal end. The conduit delivers the lighter fluid from the reservoir through the conduit to the nozzle tip. The igniter assembly generates a spark at a spark gap near the nozzle tip to ignite the lighter fluid, and has a piezoelectric component. The valve actuator is associated with the lighter fluid for selectively releasing the lighter fluid from the reservoir, and the igniter assembly. A compressor is connected to the valve actuator and when the valve actuator moves toward the nozzle tip, the valve actuator releases the lighter fuel and then sequentially activates the igniter assembly by having the compressor compress the piezoelectric component. The locking device diminishes the undesirable movement of the valve actuator.

4 Claims, 5 Drawing Sheets

U.S. PATENT DOCUMENTS

D382,172 S 8/1997 Zemel
D382,441 S 8/1997 Ferrara, Jr.
D382,442 S 8/1997 Ferrara, Jr.
D382,443 S 8/1997 Ferrara, Jr.
D382,444 S 8/1997 Ferrara, Jr.
D383,357 S 9/1997 Ferrara, Jr.
D386,045 S 11/1997 Ferrara, Jr.
5,697,775 A * 12/1997 Saito et al. ..... 431/153
D389,699 S 1/1998 Hsu
D390,749 S 2/1998 Ferrara, Jr.
D390,750 S 2/1998 Sung
D392,154 S 3/1998 Ferrara, Jr.
D393,396 S 4/1998 Ferrara, Jr.
D403,206 S 12/1998 Hsu
D406,010 S 2/1999 Tubby et al.
5,865,614 A 2/1999 Hsu
D407,945 S 4/1999 Moran, IV
D410,363 S 6/1999 Tubby et al.
D410,819 S 6/1999 Hsu
5,919,037 A 7/1999 Brillhart, III et al.
D415,389 S 10/1999 Ferrara, Jr.
5,975,888 A 11/1999 Hsu
5,980,242 A 11/1999 Man
D421,876 S 3/2000 Hsu
6,050,810 A 4/2000 Huang
D424,372 S 5/2000 Chevalier
D424,373 S 5/2000 Aronson, II
D424,374 S 5/2000 Stein
D425,369 S 5/2000 Sung
6,086,360 A 7/2000 McDonough et al.
D428,766 S 8/2000 Galimond
D429,445 S 8/2000 Sung
D435,397 S 12/2000 Sung
D436,290 S 1/2001 Harel
6,168,423 B1 1/2001 Man
D437,526 S 2/2001 Umemoto
D437,732 S 2/2001 Chevalier
6,186,777 B1 2/2001 Ferrara et al.
D440,821 S 4/2001 Yu
6,213,759 B1 4/2001 Sung

* cited by examiner

UTILITY LIGHTER

CLAIM OF PRIORITY

This invention claims priority to U.S. provisional application No. 60/308,348, filed on Jul. 27, 2001.

FIELD OF THE INVENTION

The present invention relates to a utility lighter.

BACKGROUND OF THE PRESENT INVENTION

There are numerous utility lighters on the market. Utility lighters all have a rod-like top end portion and a main body. The rod-like top end portion has a jetting nozzle for jetting out a fuel to form a flame protruding therefrom. The main body has the following elements:

1) a fuel tank,
2) a valve mechanism for opening and closing a path, through which the fuel is supplied from the fuel tank to the jetting nozzle,
3) a spark generating device which lights the fuel and the spark is generated by a conventional piezo-electric unit or a conventional flint wheel assembly, and
4) an operation member which drives the valve mechanism and the spark generating device in order to carry out the lighting operation.

Such devices are well known to those skilled in the art.

Internationally, there is a drive for such lighters to become child resistant. It is has come to the applicant's attention that Saito et al. in U.S. Pat. No. 5,697,775 and Fremund in U.S. Pat. No. 5,076,783, disclose similar child safety devices for lighters. In particular, both patents claim and disclose a safety device having the following generic elements:

a) a locking member, which interferes with the operation member and thereby locks the lighting operation of the operation member, the locking member being capable of moving in a direction, that intersects with the direction along which the operation member moves, and
b) an urging member which urges the locking member to a locking direction,
c) the safety device being provided with an unlocking member, which is capable of being operated in order to move the locking member in a direction, that acts against the urging force of the urging member, the unlocking member being projected to the exterior of the main body on the side opposite to the operation member,
   wherein when the locking member is released from a position preventing the lighting operation by operating the unlocking member, the lighting operation is carried out by operating the operating section of the operation member, and the locking member automatically returns to the state of the locking as the operation member returns to its original position.

The particular locking members and the operating members of Saito et al. and Fremund, however, are not always stable and do not provide the desired child resistant characteristics.

For example, Saito et al. disclose a bar-like shaft, which is inserted transversely through the main body, and an engagement section, which is located at one end of said bar-like shaft. The engagement section is designed to be inserted into an engagement groove of the operation member to interfere with the movement of the operation member. It is possible that the engagement section can become permanently positioned in the engagement groove to render the utility lighter useless or the engagement section can become dislodged so the utility lighter has no child resistance at all.

In contrast, Fremund discloses "when the lighter is not being used, [a] spring . . . has [a] locking slide . . . pushed to the right overlying [a] spring-loaded latch . . . and [a] lower end . . . of [a] locking rod . . . rests on the right hand end . . . of the locking slide . . . and it cannot be depressed and the lighter cannot be operated. When it is desired to use the lighter, the user pushes on [a] projection . . . on the locking slide . . . and pushes the locking slide to the left to free the latch . . . and actuating locking rod. . . . The latch . . . hits a notch . . . on the inside of the outer wall of the lighter assembly and is in such a position that the slide . . . cannot move to the right. Now the user can operate the activating lever . . . and to light the lighter. When the lever . . . is compressed, the spring latch . . . is pushed down and the locking slide . . . , whose end overlies slightly the spring-loaded latch . . . , is pushed to the right to rest against the locking rod. . . . When the lighter actuating lever . . . returns, it pulls the locking rod . . . upwardly above the locking slide's right hand end. . . . This allows the locking slide . . . to return, by the force of the spring . . . , to its rightmost position and to lock the locking rod . . . again in the inoperative position." As disclosed, Fremund's child resistant system has stability problems because the locking slide is a single rod that can easily break.

Thus, there remains a need for a utility lighter which resists unwanted actuation, minimizes wiring, ignites efficiently and reliably, and minimizes the impact of manufacturing variances. The present invention solves these problems.

SUMMARY OF THE INVENTION

The present invention is directed to a utility lighter having a housing, a nozzle, a lighter fluid reservoir, a conduit, an igniter assembly, a valve actuator, and a locking device. The housing has a top side, a bottom side, sides, a distal end, and a proximal end. The nozzle extends away from the distal end and has a nozzle tip. The lighter fluid reservoir is in the distal end. The conduit delivers the lighter fluid from the reservoir through the conduit to the nozzle tip. The igniter assembly generates a spark at a spark gap near the nozzle tip to ignite the lighter fluid, and has a conventional piezoelectric component. The valve actuator is associated with the lighter fluid for selectively releasing the lighter fluid from the reservoir, and the igniter assembly. A compressor is connected to the valve actuator and when the valve actuator moves toward the nozzle tip, the valve actuator releases the lighter fuel and then sequentially activates the igniter assembly by having the compressor compress the piezoelectric component. The locking device diminishes the undesirable movement of the valve actuator.

DETAILED DESCRIPTION OF THE INVENTION

Figure 1:
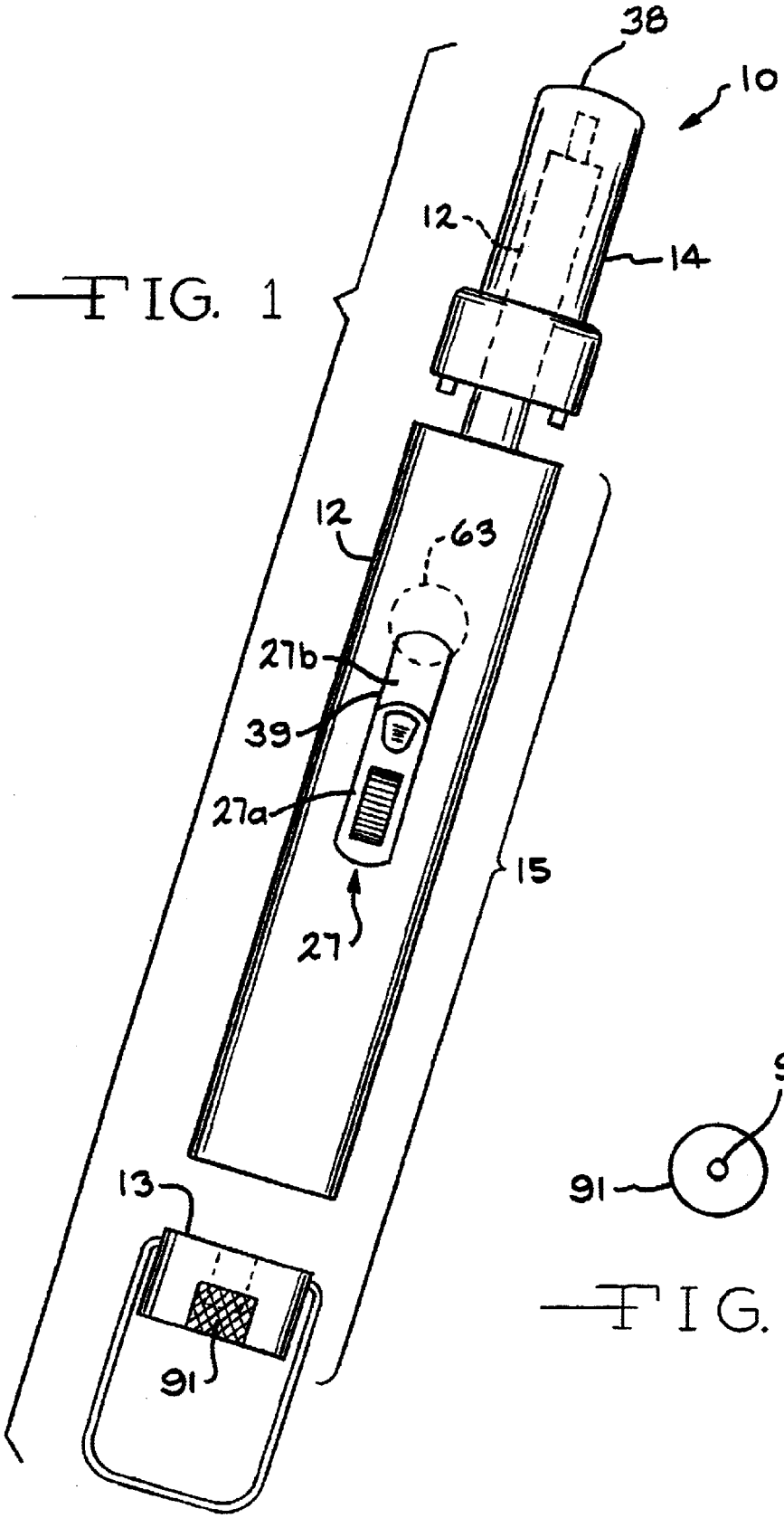
FIG. 1 illustrates an exploded view of the present invention with the housing 12.
Figure 2B:
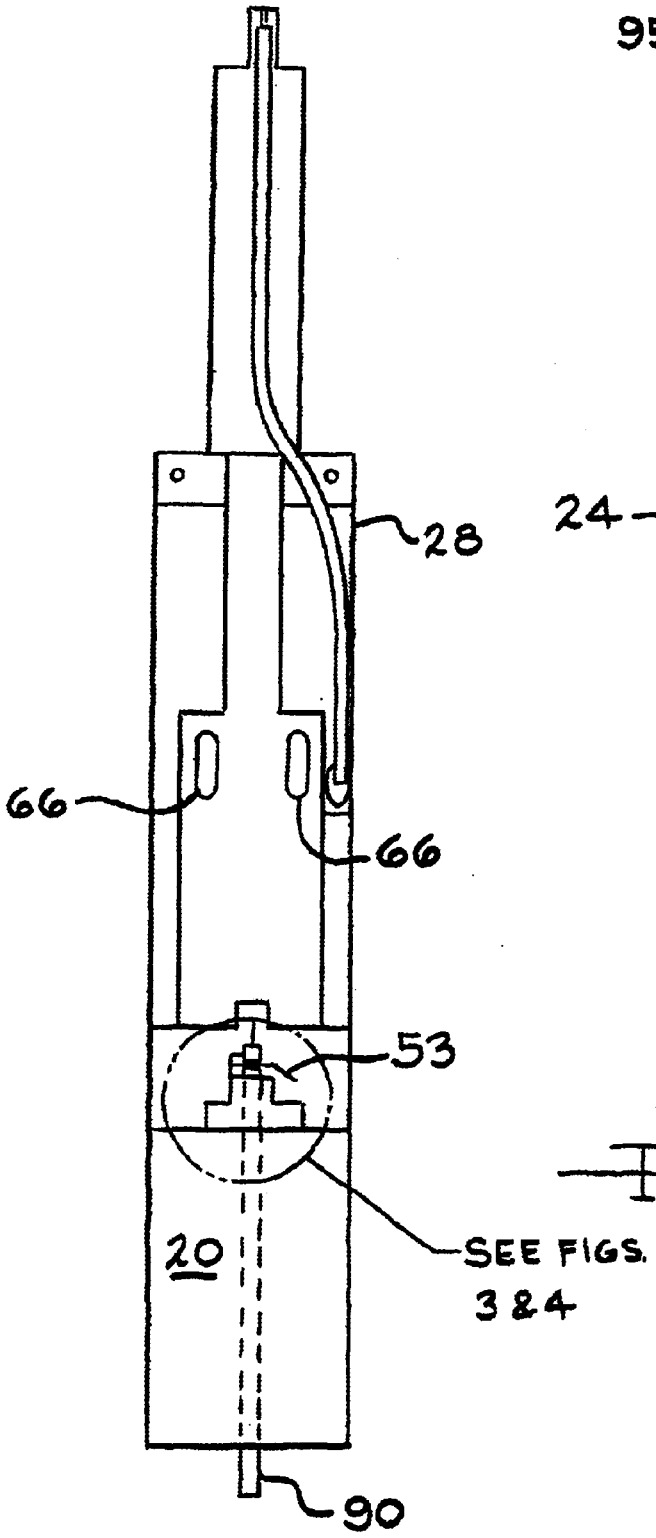
FIG. 2*b* illustrates FIG. 2*b* without the operation member 27*b*.
Figure 2A:
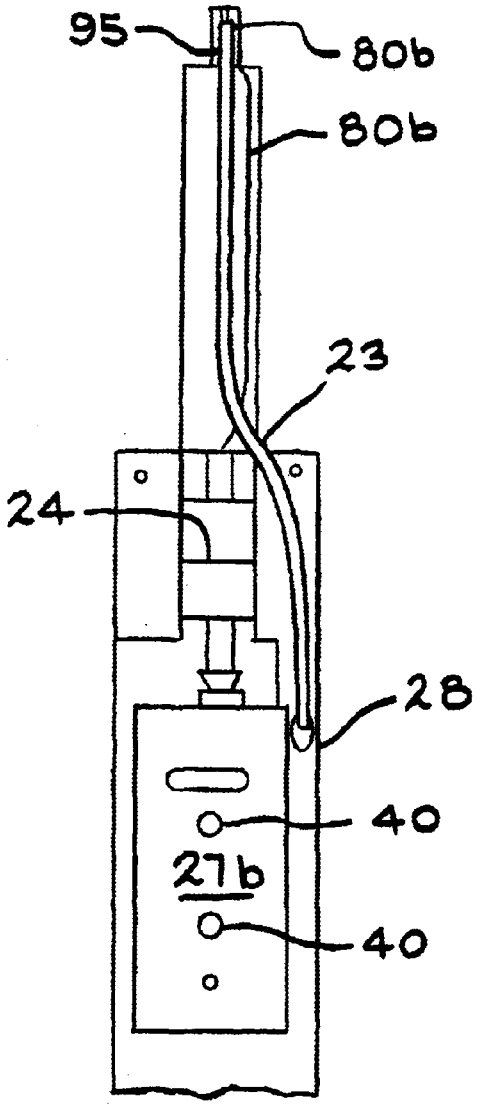
FIG. 2*a* illustrates FIG. 1 without the housing 12 and the operation member 27*a*.
Figure 3:
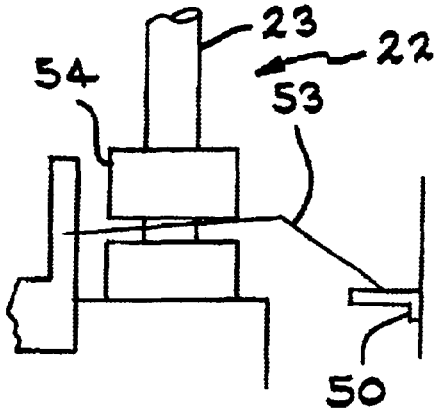
FIG. 3 illustrates a valve mechanism in the open position.

The present invention is a utility lighter 10, as illustrated in FIG. 1. In FIG. 1, the utility lighter 10 illustrates an exterior housing 12 and an end cap 13 which define a main body 15, and a nozzle 14. The main body 15 contains many of the components that allow the utility lighter 10 to generate a flame at the terminal end 38 of the nozzle 14. These main components are 1) a fuel tank 20 as shown in FIGS. 2*a* and *b*,
2) a valve mechanism 22 for opening (as shown in FIG. 3) and closing (see FIG. 4) a conduit 23, through which the fuel is supplied from the fuel tank 20 to the terminal end 38,
3) a spark generating device 24 which lights the fuel from the conduit 23 at the terminal end 38 and as shown in FIG. 5*a* a spark 25 is generated when a resilient extension member 26 is compressed, as shown in relation between FIGS. 5*a* and 5*b*, wherein the device 24 is a conventional piezo-electric unit assembly,
4) an operation member 27 which drives the valve mechanism 22 and the spark generating device 24 in order to carry out the lighting operation, and
5) an internal housing 28 that holds all the main components in the proper position.

The operation member 27 is divided into two components, a finger member 27*a* and an internal member 27*b*. The finger member 27*a* is designed to allow a user's fingers (or thumb) to easily slide the operation member 27 toward the terminal end 38. The finger member 27*a* protrudes from an operation aperture 39 of the housing 12.

The internal member 27*b* has a plurality of apertures 40. The apertures 40 receive corresponding prongs 41 which extend from the finger member 27*a*. That way, the finger member 27*a* is securely attached to the internal member 27*b*. The internal member 27*b* remains within the housing 12 but a portion of the internal member 27*b* can be exposed through the operation aperture 39.

Figure 6:
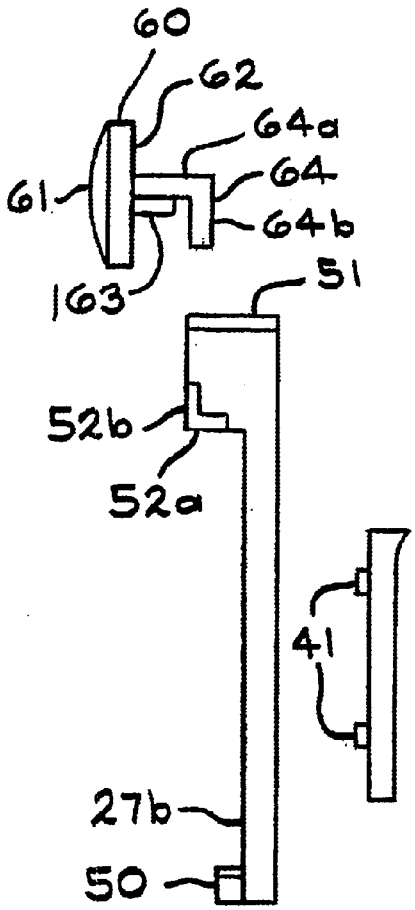
FIG. 6 is a side view of the safety unit and the operation member, without the interior housing.
Figure 7:
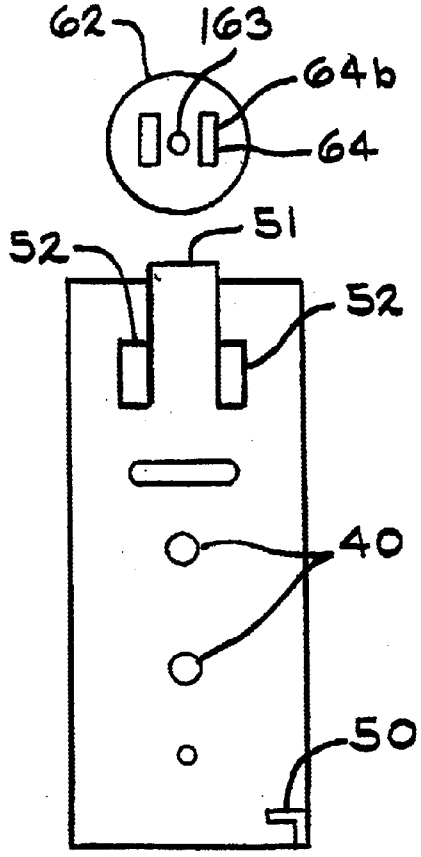
FIG. 7 is the bottom side of the operation member.

On the opposite side of the internal member 27*b* that has the finger member 27*a* (as shown in FIG. 6), are a valve latch 50, a driving head 51, and at least one interference member 52, as shown in FIG. 7. The valve latch 50 is designed to be positioned to drive a latch 53 of the valve mechanism 22 toward the terminal end 38 when the operation member 27 is moved forward. By moving the latch 53 forward, as shown in FIG. 3, the fuel from the fuel tank 20 is released into the conduit 23.

Figure 4:
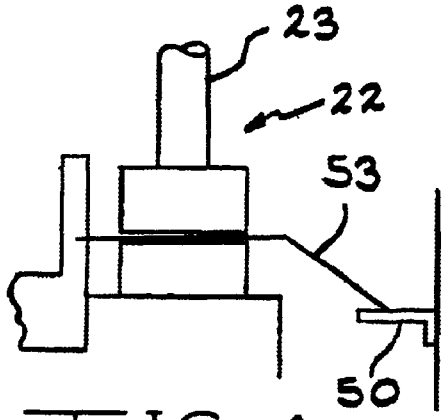
FIG. 4 illustrates the valve mechanism in the closed position.
Figure 5A:
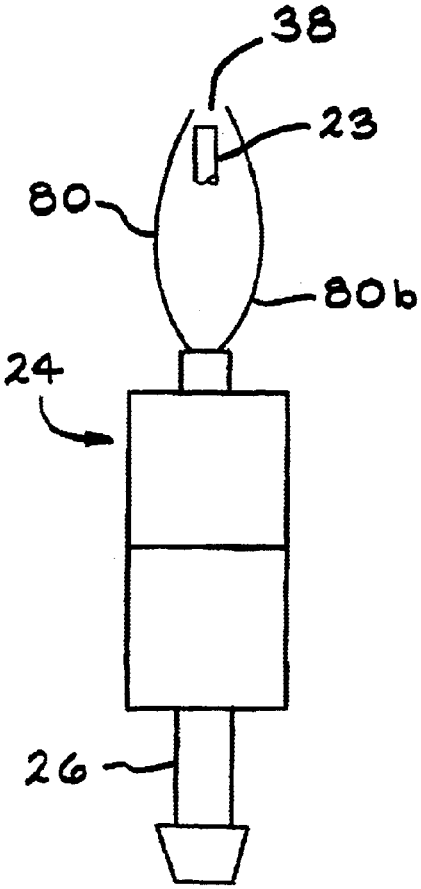
FIG. 5*a* illustrates the spark generating device 24 in its relaxed state.
Figure 5B:
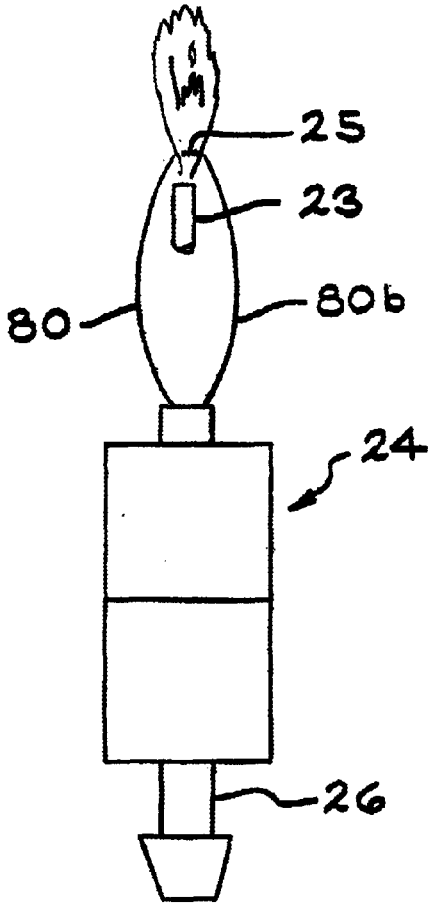
FIG. 5*b* illustrates the spark generating device 24 in its potential energy state with a spark 25 at the spark gap.

The latch 53 is attached to a compression conduit 54 that when the latch 53 not moved forward, as shown in FIG. 4, the compression conduit 54 does not allow the fuel to be released from the tank 20 into the conduit 23. And when the latch 53 is moved forward as shown in FIG. 3 the compression conduit 54 allows the fuel to be released from the tank 20 into the conduit. The latch 53, however, is not moved forward until the operation member 27 is moved forward.

The operation member 27 cannot move forward until the safety unit 60 is moved into the housing 12 a predetermined distance. The safety unit 60 is divided into an external cap 61 and a resilient interference protrusion unit 62. The external cap 61 protrudes from the housing 12 through a safety aperture 63, which is on the opposite side of the operation aperture 39 and when a user examines just the housing 12 through the operation aperture, the user will see a portion (the portion facing away from the terminal end 38) of the safety aperture 63.

The protrusion unit 62 is larger (a shoulder) than the safety aperture 63 (that way it will not be displaced from the lighter 10), and has at least one resilient member 163 that forces the unit toward the safety aperture 63, and at least one "L" shaped protrusion 64, wherein the L faces away from the terminal end 38. The L shaped protrusion 64 is divided into a vertical extension 64*a* and a horizontal extension 64*b*.

Figure 8:
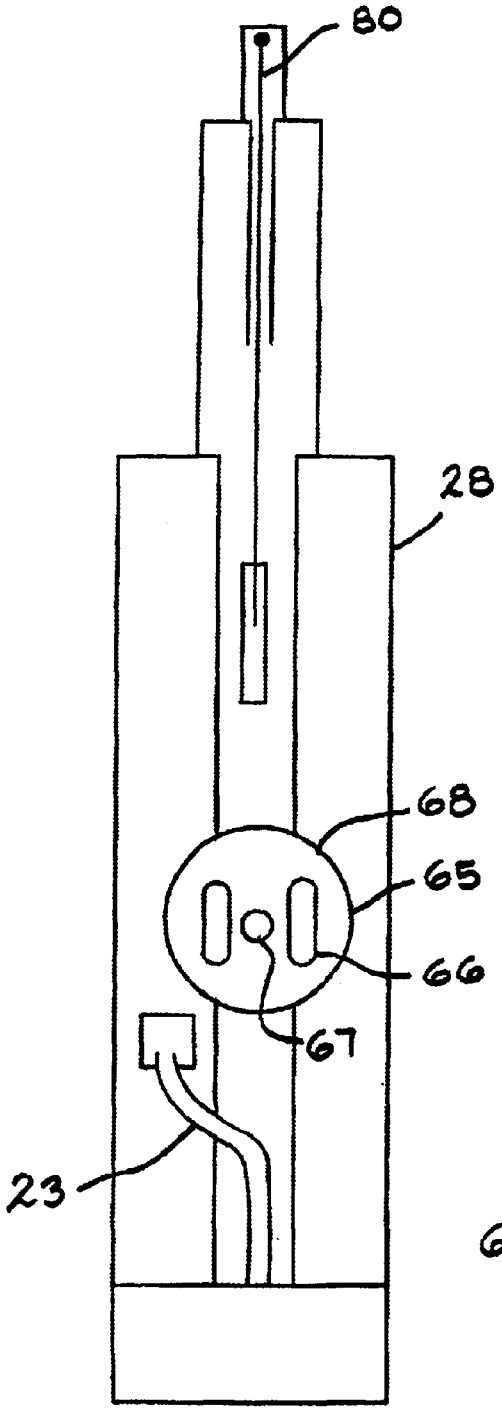
FIG. 8 is the bottom side of FIG. 2*b* without the tank.

The unit 62 is positioned to contact the internal housing 28, opposite the operation member 27, within a safety receiver 65, as shown in FIG. 8. The safety receiver 65 has at least one protrusion aperture 66, at least one protrusion 67 which receives the resilient member 163, and a boundary wall 68 that contains the safety unit 60 within the lighter 10. That way, the unit 62 in the relaxed mode is pushed toward the safety aperture 63.

Figure 9:
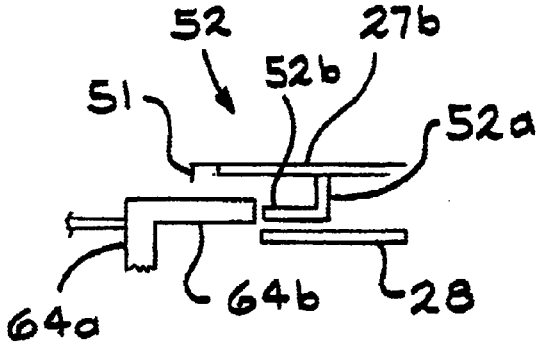
FIG. 9 is side operational view of the safety unit and the operation member in their relaxed states.

When the unit 62 is in the relaxed mode, the protrusion 64 member is positioned within a corresponding protrusion aperture 66. In particular, the horizontal extension 64*b* protrudes just beyond the protrusion aperture 66 as shown in FIG. 9. In that position, horizontal extension 64*b* interferes with the movement of the operation member 27. In particular, the operation member 27 has a corresponding "L" shape unit 52 having a vertical member 52*a* that protrudes toward the interior housing 28 and a horizontal member 52*b*. The horizontal member 52*b* and horizontal extension 64*b* are designed to contact each other when the unit 62 is in the relaxed state, as shown in FIG. 9. By contacting each other, the operation member 27 is unable to move forward and thereby the user is unable to operate the lighter 10.

Figure 10:
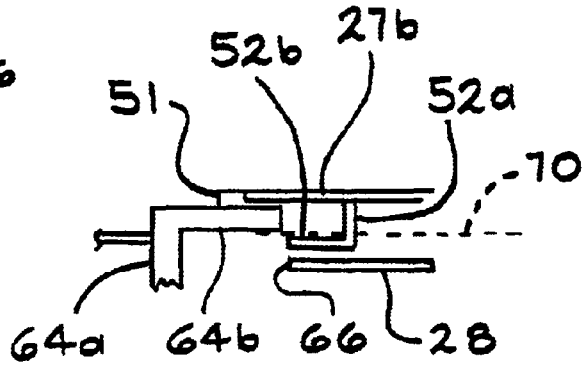
FIG. 10 illustrates a side operation view of the safety unit in its potential energy state and the operational member in its relaxed state.

When the user depresses the unit 62 into the housing 12, the protrusion 64 is moved further into the housing 12. That means the horizontal extension 64*b* is positioned above the upper surface 70 of the horizontal member 52*b*, as shown in FIG. 10. Once the unit 62 is in this potential energy position, the user can now freely move the operation member 27 forward toward the terminal end 38 because the horizontal extension 64*b* and the horizontal member 52*b* will not contact each other.

Once the operation member 27 is moved forward toward the terminal end 38, the operation member 27 drives the valve mechanism 22 and the spark generating device 24 in order to carry out the lighting operation. How the operation member 27 drives the valve mechanism 22 is set forth above.

The operation member 27 drives the spark generating device 24 through the driving head 51. The driving head 51 is moved forward and contacts the spark generating device 24. Device 24 is a conventional piezoelectric lighter unit that amplifies the contact force of the driving head 24 through the resilient extension member 26 to generate the standard electrical impulse from the piezoelectric unit for generating the spark near the terminal end 38.

The electrical impulse is transmitted through a wire 80 and the spark 25 is generated when the electrical signal has to jump (spark gap) to corresponding electrical contact 80*b*. When the spark 25 is generated, the fuel from the tank 20 was released into the conduit 23 that directs the fuel to a metallic conduit 95 that simultaneously transmits the fuel and is the receiving contact 80*b* of the spark 25. That way, the fuel is lit, and the lighter 10 has generated its desired flame with a quality safety system.

Once the user wants to terminate the flame, the user merely releases the operation member 27. The operation member 27 through the resilient extension member 26 will return the operation member to the relaxed state illustrated in FIG. 9. Also, the user can release the safety unit 60, which will also return to the relaxed state, illustrated in FIG. 9, in response to the resilient member 163.

Figure 11:
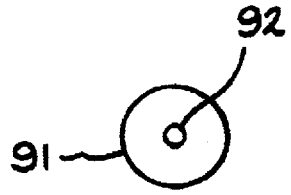
FIG. 11 is a top view of an adjustment knob.

In addition, the tank 20 has a conventional refilling port and flame adjuster control unit 90. The unit 90 protrudes from the tank 20 as illustrated in FIGS. 2*a* and *b*, and through the end cap 13. To allow the user to adjust the unit 90, the end cap 13 has an adjustment knob 91. The knob 91, as shown in FIG. 11, has an aperture 92 that allows a user to refill the tank 20, through conventional methods.

In addition, the housing 12 has a tank aperture, not shown, that allows a user to see how much fuel is in the tank 20.

Although variations in the embodiment of the present invention may not each realize all the advantages of the invention, certain features may become more important than others in various applications of the device. The invention, accordingly, should be understood to be limited only by the scope of the appended claims.

What is claimed:

1. A utility lighter comprising:

a housing having a top side, a bottom side, sides, a distal end, and a proximal end;

a nozzle extending away from the distal end and having a nozzle tip;

a lighter fluid reservoir near the proximal end;

a conduit for delivering the lighter fluid from the reservoir through the conduit to the nozzle tip;

an igniter assembly for generating a spark at a spark gap near the nozzle tip to ignite the lighter fluid, the igniter assembly has a piezoelectric component;

a valve actuator positioned between the reservoir and the igniter assembly, the valve actuator releases the lighter fluid from the reservoir, and the valve actuator initiates the operation of the igniter assembly;

a locking device to diminish undesirable movement of the valve actuator, the locking device has a button on the bottom side of the housing, the button having a shoulder, and the button having at least one blocker;

the blocker has a main section that vertically protrudes toward the top side of the housing, and a flange director section that extends horizontally from the main section toward the proximal end of the housing;

when the button is in a first position of not being depressed, the flange director section inhibits the movement of the valve actuator toward the distal end;

when the button is in a second position of being depressed, the flange director section moves toward the top side of the housing allowing the valve actuator to move toward the nozzle tip; and, a resilient member that ensures that flange director section remains in the first position when a user does not apply sufficient pressure to the button.

2. The utility lighter of claim 1 wherein the lighter fluid reservoir is refillable.

3. The utility lighter of claim 1 wherein the quantity of the fuel released from the lighter fluid reservoir is controllable.

4. The utility lighter of claim 3 wherein the quantity of the fuel released controls the size of the flame generated by the lighter.

* * * * *

UNITED STATES PATENT AND TRADEMARK OFFICE

CERTIFICATE OF CORRECTION

PATENT NO. : 6,669,466 B2
DATED : December 30, 2003
INVENTOR(S) : Tjeerd Dijkstra It is certified that error appears in the above-identified patent and that said Letters Patent is hereby corrected as shown below:

Title page,
Item [75], the Inventor's name and residence should read -- Tjeerd Dijkstra, Leiderdorp (NL) --.

Signed and Sealed this

Ninth Day of March, 2004

JON W. DUDAS
*Acting Director of the United States Patent and Trademark Office*